US007156699B1

(12) United States Patent
Liu

(10) Patent No.: US 7,156,699 B1
(45) Date of Patent: Jan. 2, 2007

(54) CONNECTOR WITH A CAPACITOR CONNECTED TO A METAL CASING

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 11/480,992

(22) Filed: Jul. 6, 2006

(51) Int. Cl.
*H01R 13/648* (2006.01)

(52) U.S. Cl. ..... 439/607; 439/620.11; 439/620.12; 439/620.19; 439/620.17; 439/620.1

(58) Field of Classification Search ..... 439/607, 439/620.11, 620.12, 620.17, 620.19, 620.1
See application file for complete search history.

(56) References Cited

U.S. PATENT DOCUMENTS 4,726,638 A * 2/1988 Farrar et al. ..... 439/620.16
4,799,901 A * 1/1989 Pirc ..... 439/620.15
5,397,250 A * 3/1995 Briones ..... 439/620.17
5,475,347 A * 12/1995 Kwak ..... 333/185
6,325,664 B1 * 12/2001 Someda et al. ..... 439/490
6,527,593 B1 * 3/2003 Handa et al. ..... 439/676
2006/0079114 A1 * 4/2006 Tsai ..... 439/394

* cited by examiner

*Primary Examiner*—Chandrika Prasad
*Assistant Examiner*—Harschad C Patel
(74) *Attorney, Agent, or Firm*—Posz Law Group, PLC; R. Eugene Varndell, Jr.

(57) ABSTRACT

A connector has a socket, a circuit board, a capacitor and a casing. The socket has an inner end and a sidewall. The circuit board is mounted transversely in the socket near the inner end and has an inner surface and an outer surface. The capacitor is mounted on the inner surface of the circuit board and has two leads. One lead extends around the inner end of the socket and against the outside surface of the sidewall. The casing covers the socket and clamps the lead against the outside surface of the sidewall to form the grounding device.

3 Claims, 4 Drawing Sheets

CONNECTOR WITH A CAPACITOR CONNECTED TO A METAL CASING

BACKGROUND OF THE INVENTION

1. Field of the Invention

The present invention relates to a connector, and more particularly to a connector with a grounding device that uses a leg of a capacitor to form the grounding device.

2. Description of Related Art

Electric devices are used to transfer information throughout the modern world. The information is often transferred through cables. The electric devices need at least one connector to allow cables to plug into the devices.

A conventional connector comprises a socket, a circuit board, multiple terminals, a casing and a grounding device. The socket has an inner end. The circuit board is mounted in the socket near the inner end and has an inner surface and an outer surface. The terminals are mounted the circuit board and protrude from the outer surface into the socket. The casing covers the socket. The grounding device terminates static electricity when information is transferred, can be formed as an electric circuit, is connected to the circuit board and extends out of the casing.

Consequently, the grounding device is an additional part of the connector assembly so connector manufacturers need to prepare extra parts to assemble the connectors. The extra parts may necessitate additional work and add significant cost to the fabrication and assembly of the connectors.

To overcome the shortcomings, the present invention provides a connector to obviate or mitigate the aforementioned problems.

SUMMARY OF THE INVENTION

The primary objective of the present invention is to provide a connector with a grounding device formed from parts of a connector to make connector assembly more convenient.

The connector in accordance with the present invention has a socket, a circuit board, a capacitor and a casing. The socket has an inner end and a sidewall. The sidewall has an outside surface. The circuit board is mounted transversely in the socket near inner end and has an inner surface and an outer surface. The capacitor is mounted on the inner surface of the circuit board and has two leads. One lead extends around the inner end of the socket and against the outside surface of the sidewall. The casing covers the socket and clamps the lead against the outside surface of the sidewall to form the grounding device. Consequently, manufactures of the connector use requisite parts of the connector to form the grounding device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
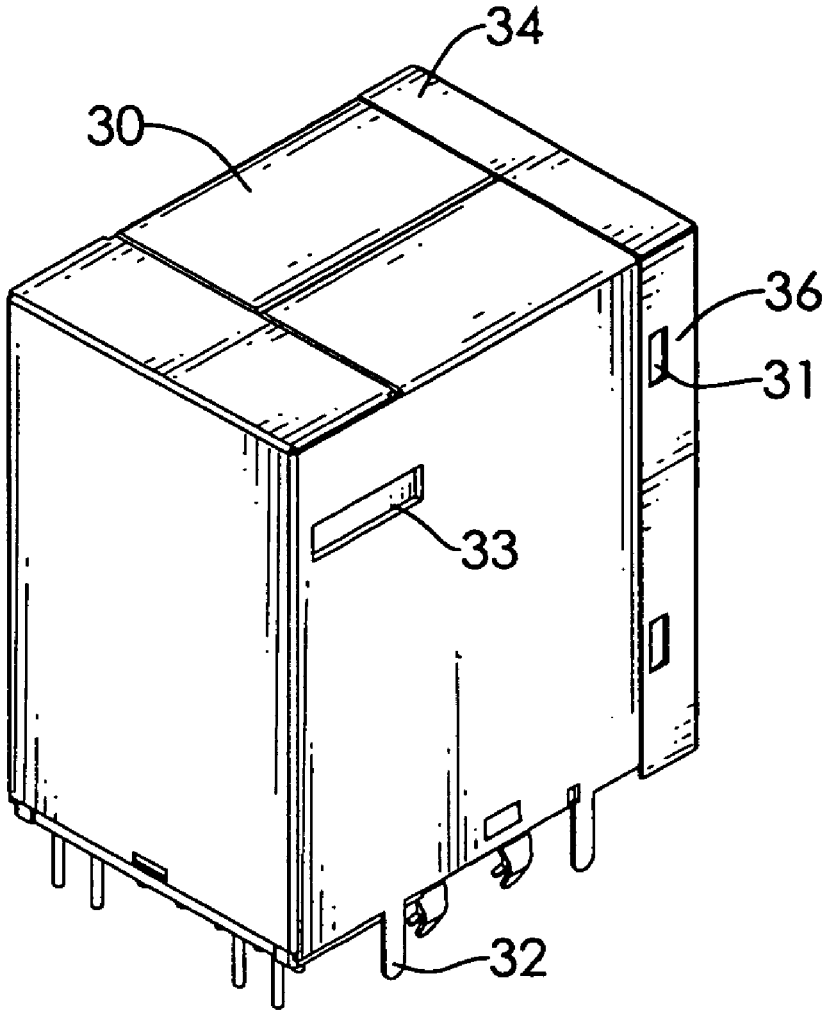
FIG. 1 is a perspective view of a connector in accordance with the present invention.
Figure 2:
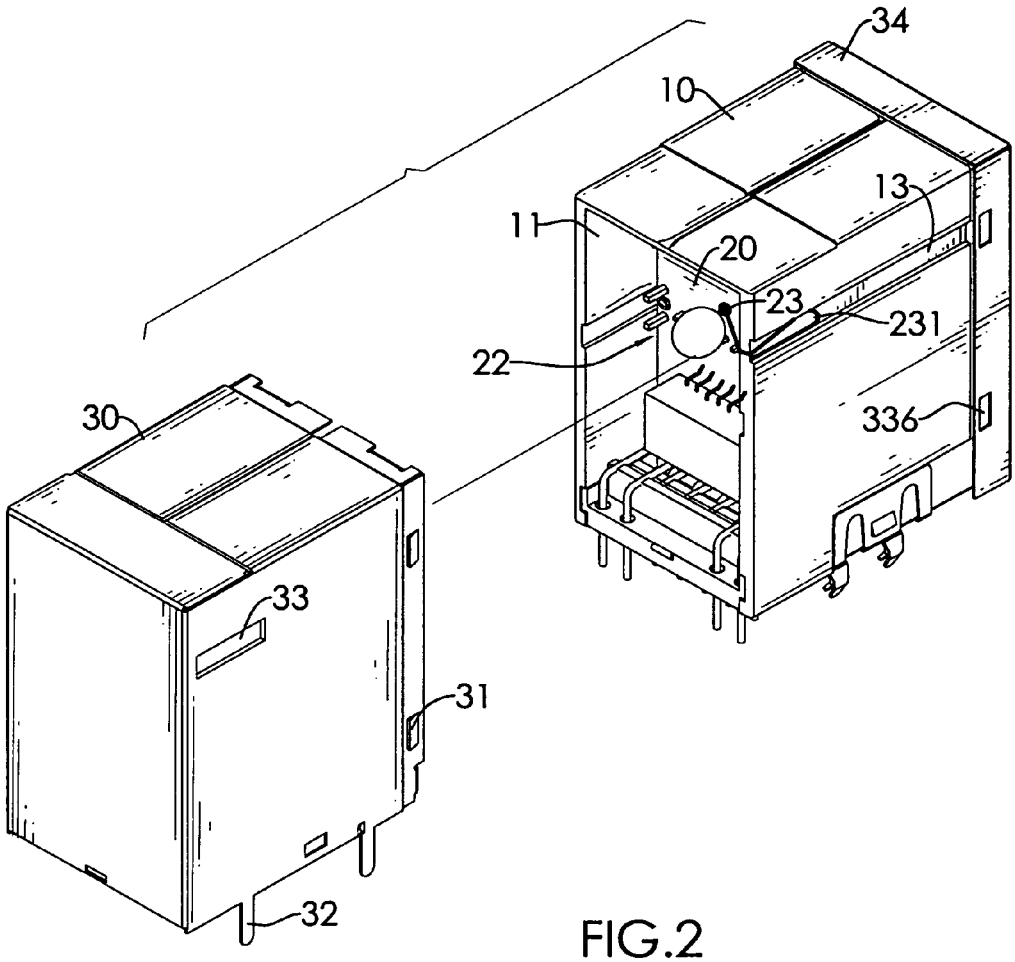
FIG. 2 is an exploded perspective view of the connector in FIG. 1.

With reference to FIGS. 1 and 2, a connector in accordance with the present invention comprises a socket (10), a circuit board (20), terminals (22), a capacitor (23), a casing (30) and a cover (34).

Figure 3:
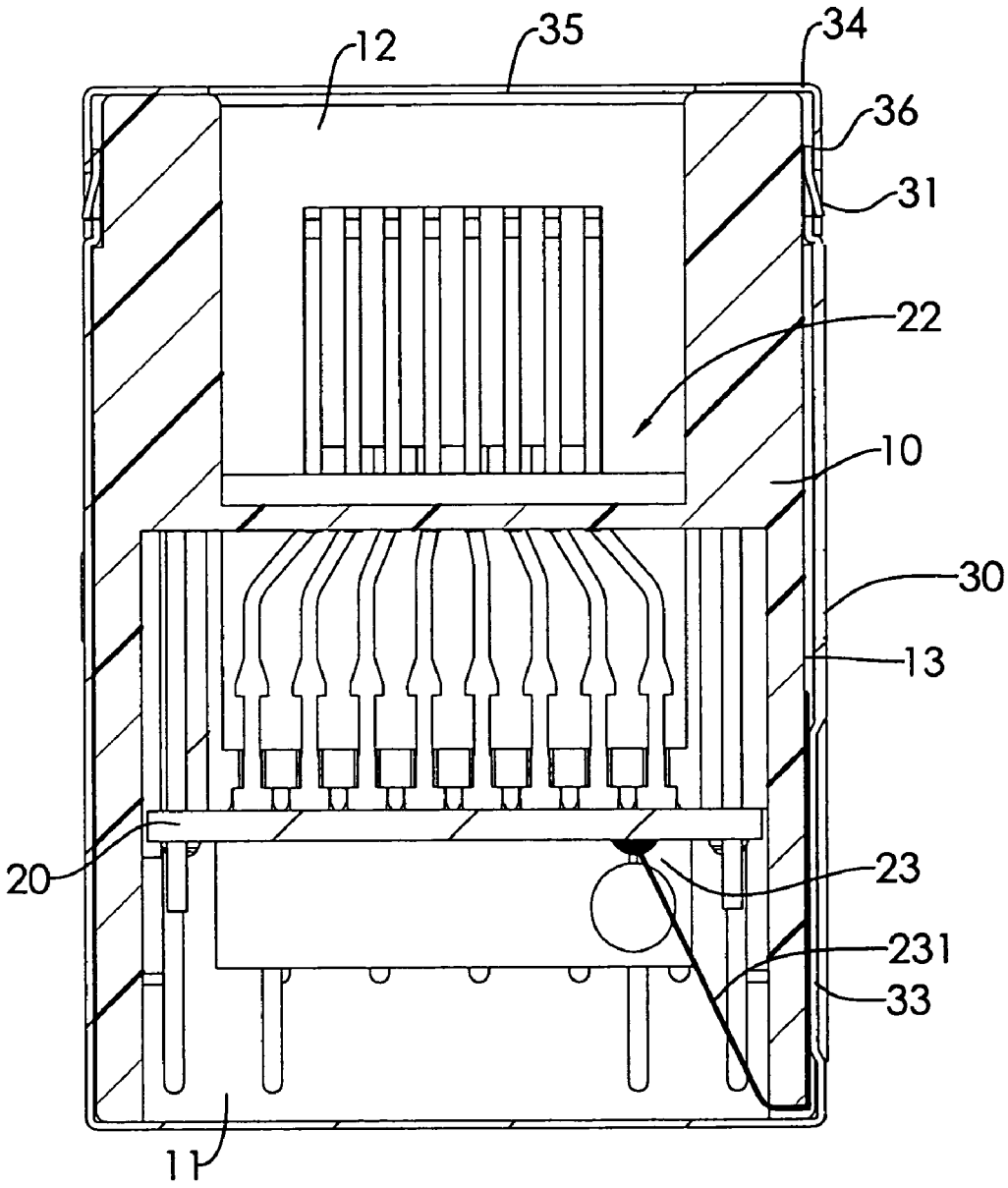
FIG. 3 is a cross sectional top view of the connector in FIG. 1.

With further reference to FIG. 3, the socket (10) has an inner end (11), an outer end (12), a sidewall and an optional guide slot (13). The outer end (11) corresponds to and communicates with the inner end (12). The sidewall has an outer surface. The guide slot (13) is formed longitudinally in the outer surface of the sidewall of the socket (10) from the inner end (12) toward the outer end (11) of the socket (10).

The circuit board (20) is mounted transversely in the socket (10) near the inner end (11) and has an inner surface and an outer surface.

The terminals (22) are mounted in the circuit board (20) and protrude from the outer surface into the socket (10).

The capacitor (23) is mounted on the inner surface of the circuit board (20) and has two leads (231). One lead (231) extends around the inner end (11) of the socket (10) against the outer surface of the sidewall and may extend into the guide slot (13) of the socket (10).

Figure 4:
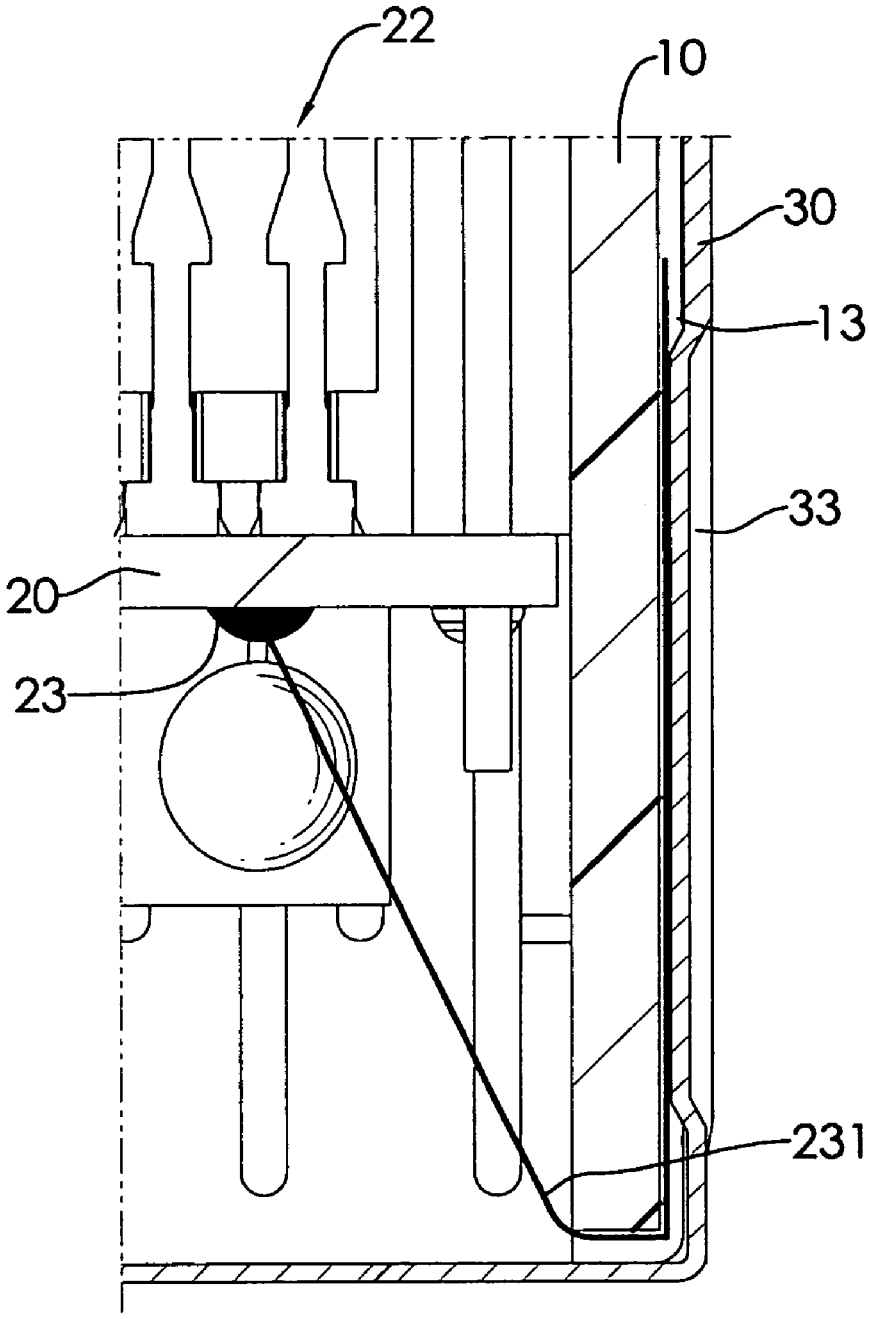
FIG. 4 is an enlarged cross sectional top view of the connector in FIG. 3.

The casing (30) is hollow and metal, covers the socket (10) and has an open front, a closed rear, a top, an open bottom, two sides, an optional guide rail (33), a bottom edge, optional mounting prongs (32), a front edge and optional mounting tabs (31). The sides are mounted respectively against the sidewalls of the socket (10), and each side has an inside surface. The inside surface of one side clamps the lead (231) of the capacitor (23) against the sidewall of the socket (10). With further reference to FIG. 4, the guide rail (33) is formed on the casing (30), corresponds to the guide slot (13) in the socket (10) and has an inner surface. The inner surface of the guide rail (33) clamps the lead (231) of the capacitor (23) in the guide slot (10) between the guide rail (33) and the guide slot (13) in the socket (10) to form a grounding device. The mounting prongs (32) are formed on and protrude down from the bottom edge. The mounting tabs (31) are resilient and are formed on and protrude out slightly from the front edge of the casing (30).

The cover (34) is mounted on the front end of the casing (30) and has a rear edge and optional mounting holes (36). The mounting holes (36) are formed through the cover (34) near the rear edge and correspond to and hold the mounting tabs (31) on the casing (30) to hold the casing (30) on the socket (10).

Consequently, the at least one leg (231) of the capacitor (23), the guide slot (13) of the socket (10) and casing (30) form the grounding device during the connector assembly so manufactures do not have to prepare extra parts to assemble the connectors.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A connector comprising a socket having an inner end;

an outer end corresponding to and communicating with the inner end; and a sidewall; a circuit board mounted transversely in the socket near the inner end and having an inner surface; and an outer surface;

terminals mounted in the circuit board and protruding from the outer surface into the socket;

a capacitor mounted on the inner surface of the circuit board and having two leads with one lead extending around the inner end of the socket against the outer surface of the sidewall;

a casing being hollow and metal, covering the socket and having an open front;

a closed rear;

a top;

an open bottom;

two sides being mounted respectively against the sidewall of the socket, and each side having an inside surface with the inside surface of one side clamping the lead of the capacitor against the sidewall of the socket;

a bottom edge; and a front edge; and a cover being mounted on the front end of the casing and having a rear edge.

2. The connector as claimed in claim 1, wherein the socket further has a guide slot formed longitudinally in the outer surface of the sidewall of the socket from the inner end toward the outer end of the socket:

the lead of the capacitor extending around the inner end of the socket extends into the guide slot;

the casing further has a guide rail formed in one of the sides of the casing, corresponding to the guide slot in the socket and having an inner surface clamping the lead of the capacitor in the guide slot between the guide rail and the guide slot in the socket; and multiple connecting tabs being resilient and formed on and protruding out slightly from the front edge of the casing; and the cover further has multiple mounting holes formed through the cover near the rear edge and corresponding to and holding the mounting tabs on the casing to hold the casing on the socket.

3. The connector as claimed in claim 2, wherein the casing further has multiple mounting prongs formed on and protruding down from the bottom edge.

* * * * *